US008495827B2

(12) United States Patent
Aydin

(10) Patent No.: US 8,495,827 B2
(45) Date of Patent: Jul. 30, 2013

(54) PANTS PRESSING MACHINE WITH LASER ASSISTED ALIGNMENT

(76) Inventor: Mehmet Serif Aydin, Brooklyn, NY (US)

( * ) Notice: Subject to any disclaimer, the term of this patent is extended or adjusted under 35 U.S.C. 154(b) by 120 days.

(21) Appl. No.: 13/218,054

(22) Filed: Aug. 25, 2011

(65) Prior Publication Data

US 2012/0124869 A1 May 24, 2012

Related U.S. Application Data

(63) Continuation-in-part of application No. 12/001,044, filed on Dec. 10, 2007, now Pat. No. 8,006,416.

(51) Int. Cl.
*D06F 81/00* (2006.01)
*D06C 15/00* (2006.01)

(52) U.S. Cl.
USPC ..... 38/16; 38/17; 223/73

(58) Field of Classification Search
USPC ..... 38/14–17, 20–24, 1 B, 64, 66; 223/52–74
See application file for complete search history.

(56) References Cited

U.S. PATENT DOCUMENTS

| | | | | |
|---|---|---|---|---|
| 1,429,865 | A | | 9/1922 | Friedman |
| 1,471,676 | A | | 10/1923 | Arbes |
| 2,050,627 | A | | 8/1936 | Patterson |
| 2,719,422 | A | | 10/1955 | Abraham |
| 2,958,967 | A | | 11/1960 | Long, Sr. |
| 2,994,978 | A | | 8/1961 | Skovira |
| 3,133,366 | A | | 5/1964 | Kienzle |
| 3,491,469 | A | | 1/1970 | Niehenke |
| 3,512,379 | A | | 5/1970 | Rasmussen et al. |
| 3,556,361 | A | * | 1/1971 | O'Boyle et al. ..... 223/73 |
| 3,583,610 | A | * | 6/1971 | Forse ..... 223/57 |
| 3,589,042 | A | | 6/1971 | Airdo |
| 3,593,440 | A | | 7/1971 | Schlemon |
| 3,654,714 | A | * | 4/1972 | North ..... 38/16 |
| 3,719,311 | A | | 3/1973 | Remiarz |
| 4,543,739 | A | | 10/1985 | Zerhoch et al. |
| 5,014,453 | A | * | 5/1991 | Gratsch ..... 38/36 |
| 5,054,543 | A | * | 10/1991 | Thomas et al. ..... 165/89 |
| 5,253,378 | A | * | 10/1993 | Jung, Jr. ..... 8/149.1 |
| 5,561,880 | A | * | 10/1996 | Allen et al. ..... 8/149.3 |
| 6,240,559 | B1 | * | 6/2001 | Cares ..... 223/52.1 |

* cited by examiner

*Primary Examiner* — Ismael Izaguirre
(74) *Attorney, Agent, or Firm* — Michael I. Kroll

(57) ABSTRACT

The present invention relates to a pressing machine to be used for pressing the upper portion of a pair of wrinkled pants. The pressing machine has the contour shape of the upper portion of a pair of pants. The shape of the pressing machine makes it easier for an operator to drape a pair of pants over the machine for pressing. The shape of the pressing machine allows pants of all sizes to be pressed. The pressing machine is operated manually by pressing on two foot pedals.

17 Claims, 8 Drawing Sheets

PANTS PRESSING MACHINE WITH LASER ASSISTED ALIGNMENT

RELATED APPLICATIONS

This application is a Continuation-In-Part of U.S. patent application Ser. No. 12/001,044, having a filing date 10 Dec. 2007 and is to be issued as U.S. Pat. No. 8,006,416 having an issue date of Aug. 30, 2011.

BACKGROUND OF THE INVENTION

1. Field of the Invention

These inventions relate to pants pressing machines, specifically to such pressing machines, which are used on the pants upper portion, pant legs and for creased pants.

The puffer machine available for pressing the upper portion of a pair of pants on the market place today is limited on pressing the waist area. The biggest drawback of the puffer machine is its size, it is a small sized puffer machine with a round shape, if a pair of pants are relatively large an operator has to spend more time moving the fabric around and adjusting the pants to fit over the puffer to remove wrinkles, wasting more time just on pressing the upper portion of a pair of pants. The pants still have to be brought to a second station, to complete pressing the waist.

A newer version of the upper puffer pressing machine is electrical and a high cost machine. Since the machine is operated automatically, a switch is pressed and a lot of steam releases from the machine, steam is wasted on pressing just a small area of the pants.

Another great drawback is the upper portion puffer pressing machine also removes the creases from the leg. For an operator it is difficult to spend time searching for the original crease, so as not to make a double crease. Time is wasted looking for the original crease. And still the operator must go to another station to finish pressing the upper portion of the pants. The pocket, back seam and the waist belt area have to be touched up with a hand held flat iron. So it's a two step operation, only to press the upper portion of a pair of pants completely.

Accordingly in order to press the upper portion of a pair of pants correctly, it is conventionally necessary to move to different stations and use several different pressing machines. This as it should be apparent in addition to making it a difficult and time consuming pressing operation, also requires a large space in a pressing shop.

On the market there are pants pressing machines, but there is no equipment that exists that focuses on pressing the inseams and out seams on the legs of a pair of pants. A general pressing machine is used when pressing a pair of pants.

The greatest problem when using a general pressing machine is when the pressing plate is brought down on the legs of the pants. The pressing plate makes contact with the inseams and out seams on the pants. Therefore, impressions of the inseams and out seams are left on the fabric of the pants. Pants are also left with shiny marks along the inseams and out seams on the pant fabric and the fabric is left looking dull. If a pair of pants are to be pressed without creases, an operator must press the pants with a hand held iron, making it time consuming and costly.

Prior pressing machines that are used for pressing all garments have been around for decades. An operator brings the pressing plate down on the pants 2 times per leg. Therefore the pressing plate is brought down on the pants a total of 4 times for the entire pants.

A new pant pressing machine on the market today has been designed to have a contour crotch shape on one end and a narrow shape on the other end. Allowing small size pants to be pressed but because of the small size it is more time consuming to press larger size pants.

One drawback of the pressing machine is the narrow end, if the bottom of a pair of pants are wide, the pressing plate has to be brought down 2 times per pant leg, making it a total of 4 times the pressing plate has to be brought down to press the entire pants. The finished pressed and creased pants turn out to be more time consuming and costly.

The greatest drawback is when the pressing plates are brought down on the pants, the seams on legs of the pants are left with impression marks and the fabric is left looking shiny.

2. Description of the Prior Art

There are other pressing device designed for pants. While these pressing devices may be suitable for the purposes for which they where designed, they would not be as suitable for the purposes of the present invention as heretofore described.

SUMMARY OF THE PRESENT INVENTION

It is, therefore an object of the present invention in FIG. 1B, to provide an improved pants pressing machine that can be used for pressing the upper portion of a pair of pants, this machine completes the pressing of the waist area.

It is another object, of the present invention because of its specific designed size and shape feature it will permit relatively small and large pants to be accommodated. Small and large pants will be pressed in the same amount of time.

Accordingly, the present invention due to its manual operation will provide a quick and economic method of pressing and completing the upper portion of the pants.

Yet another object of the present invention due to its manual mechanism, it will be a smaller pressing machine than prior automatic pressing machines, making the present invention a space savor in a small shop.

The operation construction, in particular is designed to connect to a hot heated steam boiler and vacuum duct. Operated manually which can easily be made and which moreover is very competitive from a mere economic stand point.

Accordingly the aim of the present invention in reference to FIG. 2B, is to over come the above mentioned drawbacks.

The present invention has been specifically designed for pressing the inseams and out seams on the legs of a pair of pants. If the pants have a crease, the pressing machine will press the pants but it will not remove the creases. Hence, when pants do not need creases, the pressing of the pants are completed at this one pressing station.

The main object of the present invention is to provide a pants pressing machine that will leave no impression marks of the inseams and out seams on the fabric of the pants.

Another object of the present invention is to provide a pants pressing machine that presses relatively small and large pants. The rear side of the invention is 6 to 10 inches wide, the length is 32 to 37 inches and the hem side is 4 to 6 inches wide. The size and shape of the pressing machine will allow pants of all sizes to be pressed.

Due to the design of the present invention the seams are also pressed. No marks are left on the seams and if pants are lined, the lining will be pressed at the same time.

The object of the present invention in reference to FIG. 3C, is to provide an improved pants pressing machine that will be used for pressing wrinkled and creased pants.

It is the primary object of this invention to provide a pants pressing machine that will not leave the inseams and out seams on a pair of pants with any impression marks or leave the fabric looking shiny. The invention has been designed with the top pressing plate to have an indention 1 to 5½ inches wide and 1 to 3 inches deep. An operator will align the pant leg seams with the indention. When the top pressing plate is brought down, the seams fit directly into the indention. The pressing plate will not hit the seams. The inseams and out seams are left untouched and unmark. Leaving the pants creased and well pressed.

The present invention has been specifically designed to have the top and bottom pressing plates to have a contour crotch shape. The contour crotch shape will make it easy for an operator to line up the pants for pressing. The other end of the top and bottom pressing plates are wide, the present invention may be used in any size situation where some pants are relatively small or relatively large. An operator pressing a large pair of pants will only need to bring the pressing top plate down 1 time per leg. To complete the pressing it will only take bringing the pressing plate down 2 times. Thus an operator will bring the pressing plate down fewer times and spend less time to complete pressing a pair of pants. The crotch side and the hem side are the same size. So if a pair of pants is wider at the leg, the pants will still be pressed bringing the pressing plate down only once on the pants.

Yet another object of the present invention solves the problem of the fabric being left flat and looking faded. The pants pressing machines top plate has an indention, the indention area does not release steam, so the inseams and out seams on the pants are never touched, therefore the fabric of the pants are left fluffy and in its original state.

The present invention provides a pants pressing machine which will make the job of an operator quicker and easier. The invention is a manually operated machine, thus making it an economically lower cost operating pants pressing machine.

An additional object of the present invention is to provide a longitudinal framework pressing plate having a triangular shape with a transverse curvilinear surface.

Another object of the present invention is to provide a longitudinally tapered rectangular steam and vacuum framework pressing plate having a substantially co-planar top and bottom surface.

A further object of the present invention is to provide a longitudinal trough within the top plate preferably 1 to 5½ wide and 1 to 3 inches in depth so that when the top plate is moved into engagement with the bottom plate the seam will be with the trough thereby eliminating the seam having pressing marks thereon.

A yet further object of the present invention is to provide a laser projecting a line along the bottom plate as an alignment tool for the operator to place the seam of the pants leg thereover so that when the top plate having the longitudinal trough therein is moved into engagement with the bottom plate the seam will reside within said trough thereby eliminating and pressing marks on the pants leg seam.

Additional objects of the present invention will appear as the description proceeds.

The present invention overcomes the shortcomings of the prior art by providing three pressing steam apparatuses wherein one of the steam apparatus is used in pressing an upper portion of a pants, another steam apparatus is used in pressing the legs of a pair of pants and the other steam apparatus is used to form a crease in the legs of the pants.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which:

In the drawings, closely related figures have the same number but different alphabetic suffixes. Further characteristics and advantages of the present inventions will become more apparent from the following detailed disclosure of the pants pressing machines to be used for pressing the upper portion, the legs and the creases of a pair of pants.

DESCRIPTION OF THE REFERENCED NUMERALS

Figure 1A:
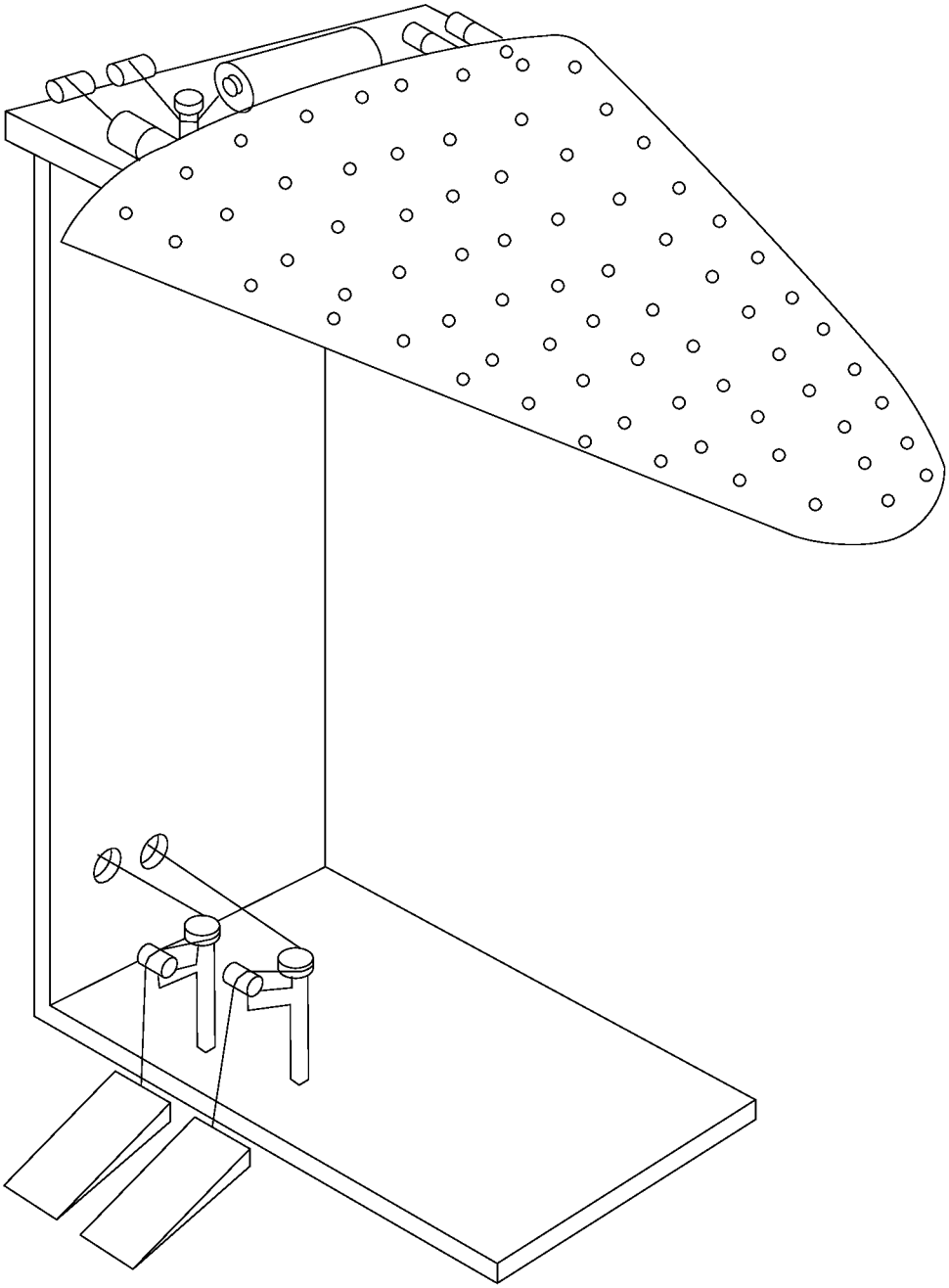
FIG. 1A is a front view of the upper portion pressing machine, illustrating a plurality of tiny steam outlet holes.

Turning now descriptively to the drawings, in which similar reference characters denote similar elements throughout the several views, the figures illustrate the Pants Pressing Machine of the present invention. With regard to the reference numerals used, the following numbering is used throughout the various drawing figures.

10 Pants Pressing Machine of the present invention
11 framework pressing plate
12 steam outlet holes
13 pin release
14 vacuum valve
15 drain valve
16 boiler valve
17 vacuum valve connection
18 wire spool
19 wheel
20 wheel
21 top base supporting structure
22 steam release valve
23 metal wired string
24 vertical side support base structure
25 wheel
26 wheel

27 cylinder
28 wheel
29 bottom base support structure
30 wheel
31 wheel
32 right foot pedal
33 left foot pedal
34 wheel
35 cylinder
36 metal wire string
37 steam pin release
41 steam outlet holes
42 framework pressing plate
43 wire spool
44 drain valve
45 boiler valve
46 vacuum valve
47 vacuum valve
48 pin release
49 wheel
50 side support base structure
51 metal wire string
52 wheel
53 wheel
54 cylinder
55 wheel
56 left foot pedal
57 right foot pedal
58 wheel
59 wheel
60 wheel
61 cylinder
62 metal wire string
63 wheel
64 steam pin release
65 top base support structure
66 steam valve
67 bottom base support structure
70 steam outlet holes
71 bottom framework pressing plate
72 back board
73 top framework pressing plate
74 longitudinal trough
75 steam outlet holes
76 open lever
77 steam release lever
78 close handle
79 top boiler valve connection
80 top drain valve connection
81 contour crotch shape
82 contour crotch shape
83 drain valve
84 boiler valve
85 vacuum valve connection
86 vacuum valve
87 vacuum pin release
88 metal wire string
89 wheel
90 left foot pedal
91 middle foot pedal
92 right foot pedal
93 bottom base support structure
94 table structure
95 laser device
96 laser generated alignment line

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Figure 1B:
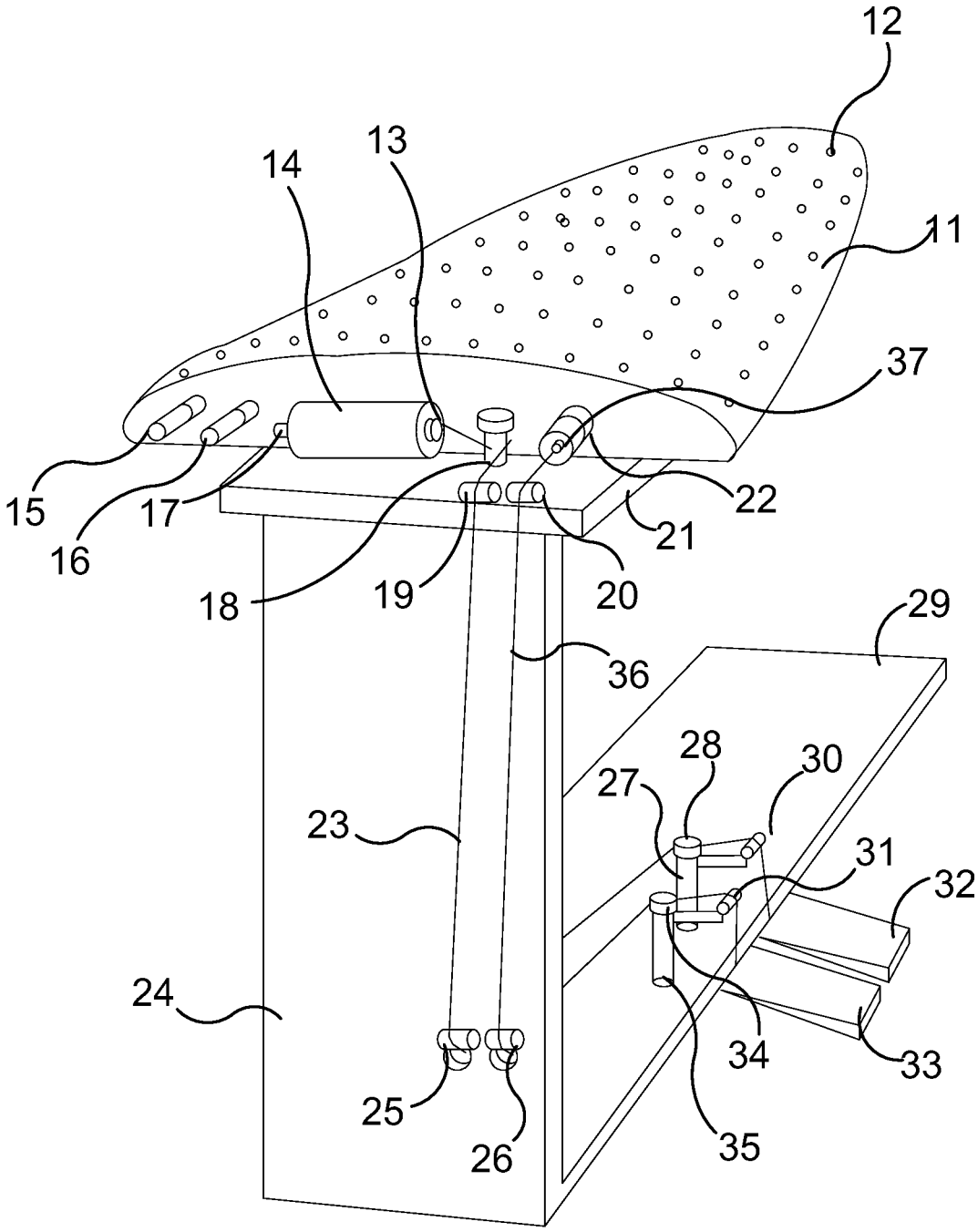
FIG. 1B is a further perspective rear view of the upper portion pressing machine, illustrating in particular the steam, drain and vacuum valve connections.

One embodiment of the pressing machines rear view is illustrated in FIG. 1B. The framework pressing plate 11 has a plurality of tiny steam outlet holes 12. In the preferred embodiment, the rear of the framework pressing plate 11 consists of having several valve connections and two release pins.

Starting from the left side of the embodiment is the first connection, a drain valve 15. The drain valve 15 connects to a drain pipe. The second valve is a boiler valve 16; the boiler valve 16 connects to a boiler. There is also a vacuum valve 14, one end of the vacuum valve 14 has a vacuum valve connection 17 and the other end of the vacuum valve 14 has a pin release 13 that pulls the vacuum valve 14. To the far right of the framework pressing plate 11 are the steam release valve 22 and the steam pin releaser 37.

The framework pressing plate 11 connects to the top support base structure 21. The top support base structure 21 has a wire spool 18. Toward the edge of the top base support structure 21 are two wheels, wheel 19 and wheel 20. The top base supporting structure 21 has a vertical side support base structure 24. The vertical side support base structure 24 towards the far right near the bottom has two wheels, wheel 25 and wheel 26. Directly underneath wheel 25 and wheel 26 are two holes. Metal wired string 23 and metal wired string 36 which will be passing through the two holes. Holding the vertical side supporting base structure 24 is the bottom base support structure 29.

The bottom base support structure 29 has two cylinders. The cylinder 35 to the left has two wheels, wheel 34 and wheel 31. Cylinder 27 to the right has two wheels, wheel 28 and wheel 30. Attached to wheel 31 by a metal wired string 23 is left manual foot pedal 33. Attached to wheel 30 by a metal wired string 36 is the right manually operated foot pedal 32.

The manner of using the upper portion pressing machine is as such one, one places the waist side of a pair of pants draped over the framework pressing plate 11. Due to the specifically designed size and shape of the framework pressing plate 11 relatively small and relatively large pants may be placed easily and pressed. The drain valve 15 is connected to a drain pipe; the boiler valve 16 is connected to the boiler. The vacuum valve 17 is connected to a vacuum.

The upper portion pants pressing machine is operated manually, one steps on the left foot pedal 33. When the left foot pedal 33 is stepped on, it pulls the metal wire string 36. The metal wire string runs through four wheels, wheel 31, wheel 34, wheel 26 and wheel 20. The metal wired string 36 pulls the steam pin release 37 which opens the steam valve 22, which opens a plurality of tiny steam outlets holes 12. Steam leaves the framework pressing plate 11 through the plurality of tiny steam outlet holes 12 through the fabric of the pants.

One then steps on the right foot pedal 32, when the right foot pedal 32 is stepped on; it pulls the metal wire string 23. The metal wired string 23 runs through four wheels, wheel 30, wheel 28, wheel 25 and wheel 19. The metal wired string 23 pulls the vacuum pin release 13, which opens the vacuum valve 14. The vacuum valve 14 pulls the steam through the tiny steam outlet holes 12 and pulls the air through the pants, cooling down the fabric. Thus leaving the upper portion of a pair of pants pressed, if pleats are needed a hand held flat iron may be applied.

Figure 2A:
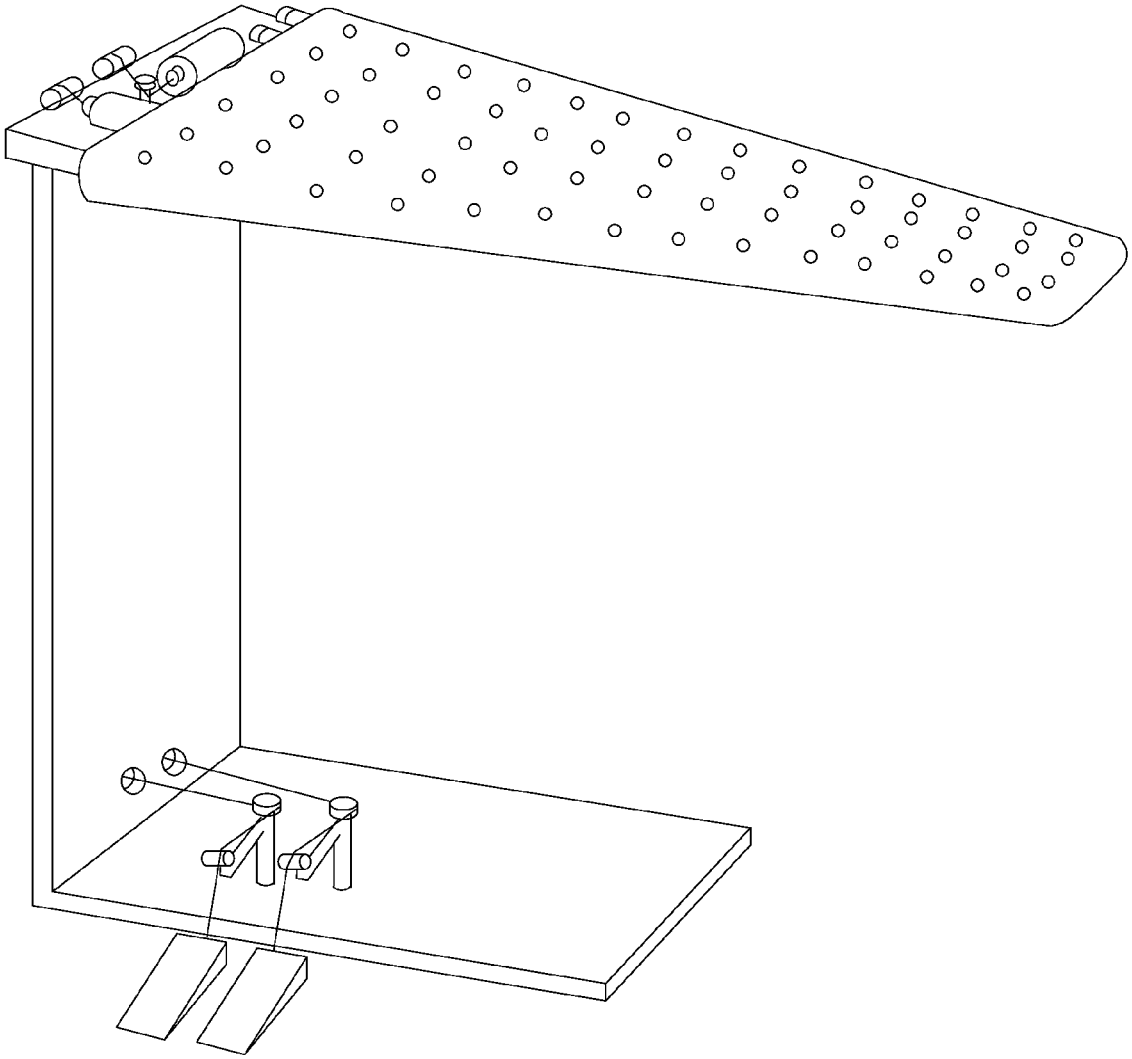
FIG. 2A is a front side view of the pressing machine, illustrating the pants size range means for pressing the legs of a pair of pants.
Figure 2B:
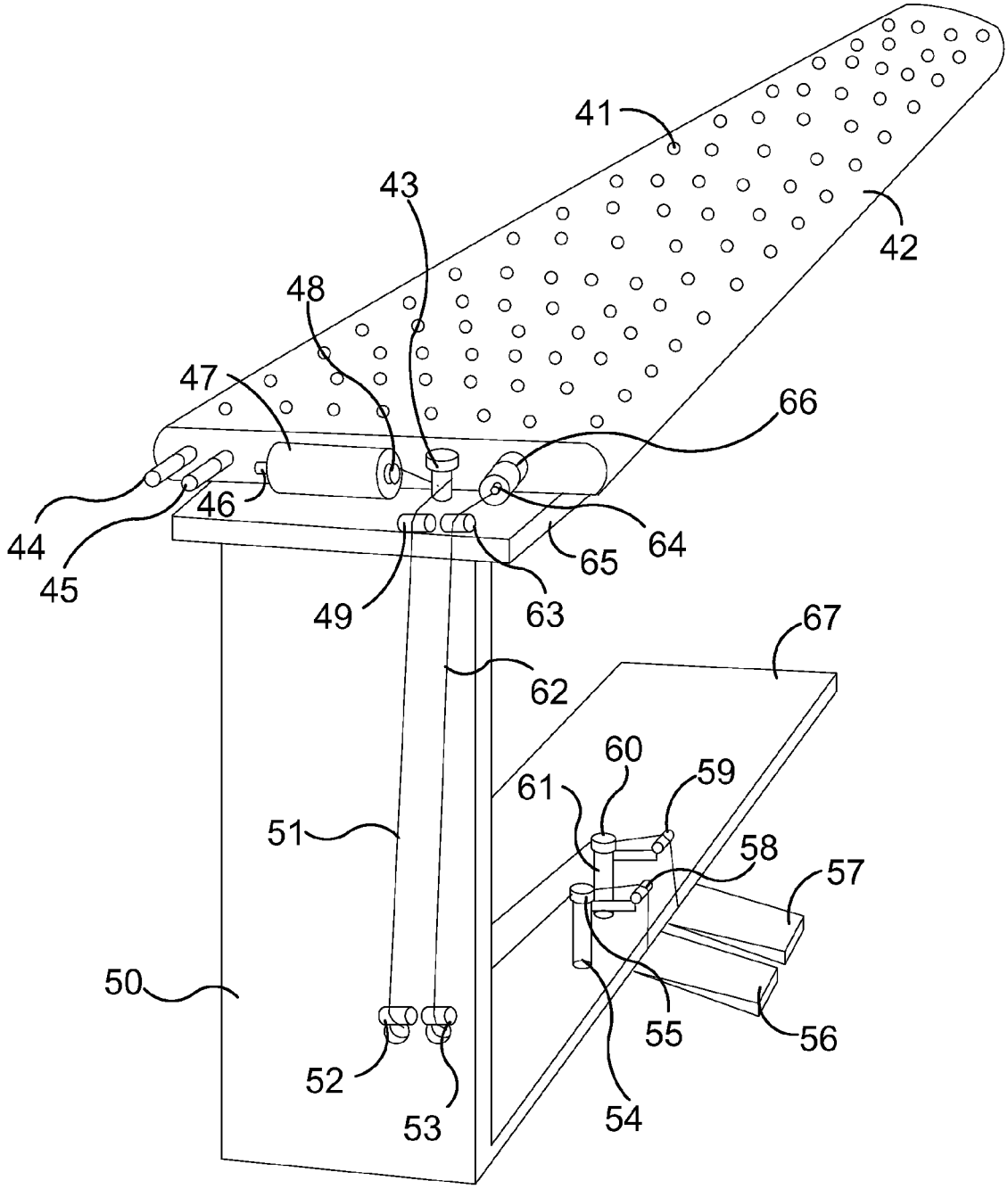
FIG. 2B is a further perspective rear view, illustrating the steam, vacuum connections and the manual foot pedals.

One embodiment of the leg pressing machine is illustrated in FIG. 2B. The long framework pressing plate 42 rear side is wide and narrow on the end of the framework pressing plate 42. The framework pressing plate 42 has a plurality of tiny steam outlet holes 41 all over the framework pressing plate 42. On the rear view of the embodiment of the framework pressing plate 42 are the valve connections and the pin releases.

Starting from the left side of the embodiment is the first connection, a drain valve 44. The drain valve 44 connects to a drain pipe. The second valve is a boiler valve 45, the boiler valve 45 connects to a boiler. There is also a vacuum valve 47, one end of the vacuum valve 47 has a vacuum valve connection 46 and the other end of the vacuum valve 47 has a pin release 48. To the far right of the framework pressing plate 42 is the steam release valve 66 and on the end of the steam release valve 66 is the steam pin releaser 64.

The framework pressing plate 42 connects to the top support base structure 65. The top support base structure 65 has a wire spool 43. Toward the right edge of the top base support structure 65 are two wheels, wheel 49 and wheel 63.

The top base supporting structure 65 has a vertical side support base structure 50. The vertical side support base structure 50 has two wheels near the bottom on the right side, wheel 52 and wheel 53. Directly underneath wheel 52 and wheel 53 are two holes. Metal wired string 51 and metal wired string 62 both which run through the two holes when pulled. Holding the vertical side supporting base structure 50 is the bottom base support structure 67.

The bottom base support structure 67 has two cylinders. The cylinder 54 to the left has two wheels, wheel 55 and wheel 58. Cylinder 61 to the right has two wheels, wheel 60 and wheel 59. Attached to wheel 58 by a metal wired string 62 is left manual foot pedal 56. Attached to wheel 59 by a metal wired string 51 is right manual foot pedal 57.

The manner of using the leg presser as shown in FIG. 2B is as such one places one leg of a pair of pants through the framework pressing plate 42. Due to the specifically designed size and length of the framework pressing plate 42 relatively small and relatively large pants may be easily draped on the framework pressing plate 42 and pressed.

The drain valve 44 is connected to a drain pipe, the boiler valve 45 is connected to the boiler. The vacuum valve 46 is connected to a vacuum duct. One steps on the left foot pedal 56. When the left foot pedal 56 is stepped on, it pulls the metal wire string 62. The metal wire string 62 runs through four wheels, wheel 58, wheel 55, wheel 53 and wheel 63. The metal wired string 62 pulls the steam pin release 64 which opens the steam valve 66 which opens the plurality of tiny steam outlet holes 41. Steam leaves the framework pressing plate 42 through the plurality of tiny steam outlet holes 41 through the fabric of the pants, removing the wrinkles.

One then steps on the right foot pedal 57, when the right foot pedal 57 is stepped on, it pulls the attached metal wire string 51. The metal wired string 51 runs through four wheels, wheel 59, wheel 60, wheel 52 and wheel 49. The metal wired string 51 pulls the vacuum pin release 48, which opens the vacuum valve 47. The vacuum valve 47 pulls the air through the plurality tiny steam outlet holes 41 and pulls the air through the pant leg, cooling down the fabric, leaving the pant leg pressed. If pants need to be creased a pants creasing pressing machine may be used.

Figure 3A:
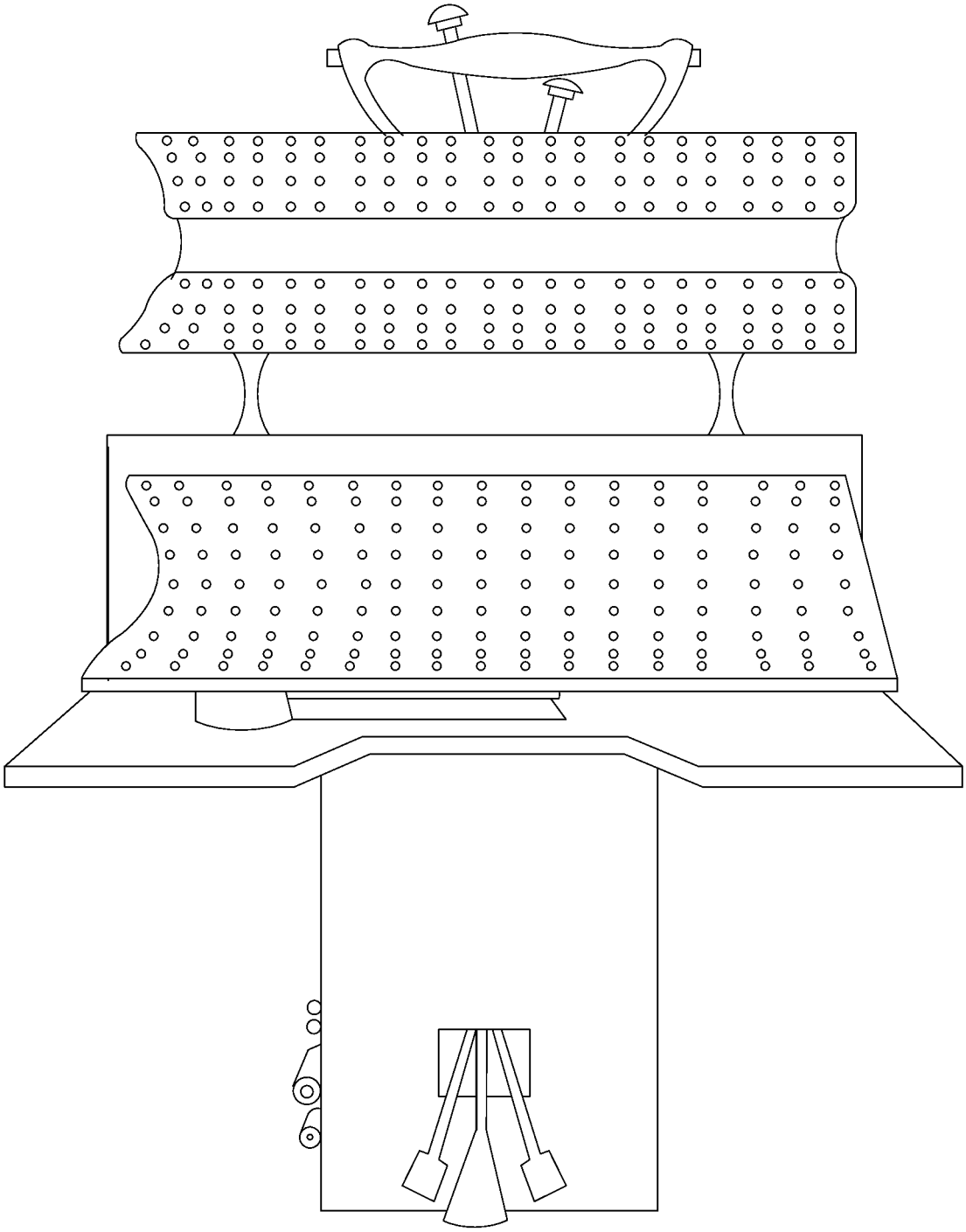
FIG. 3A is a front side view of the creasing pants pressing machine, illustrating the opening and closing means on the pressing machine.
Figure 3B:
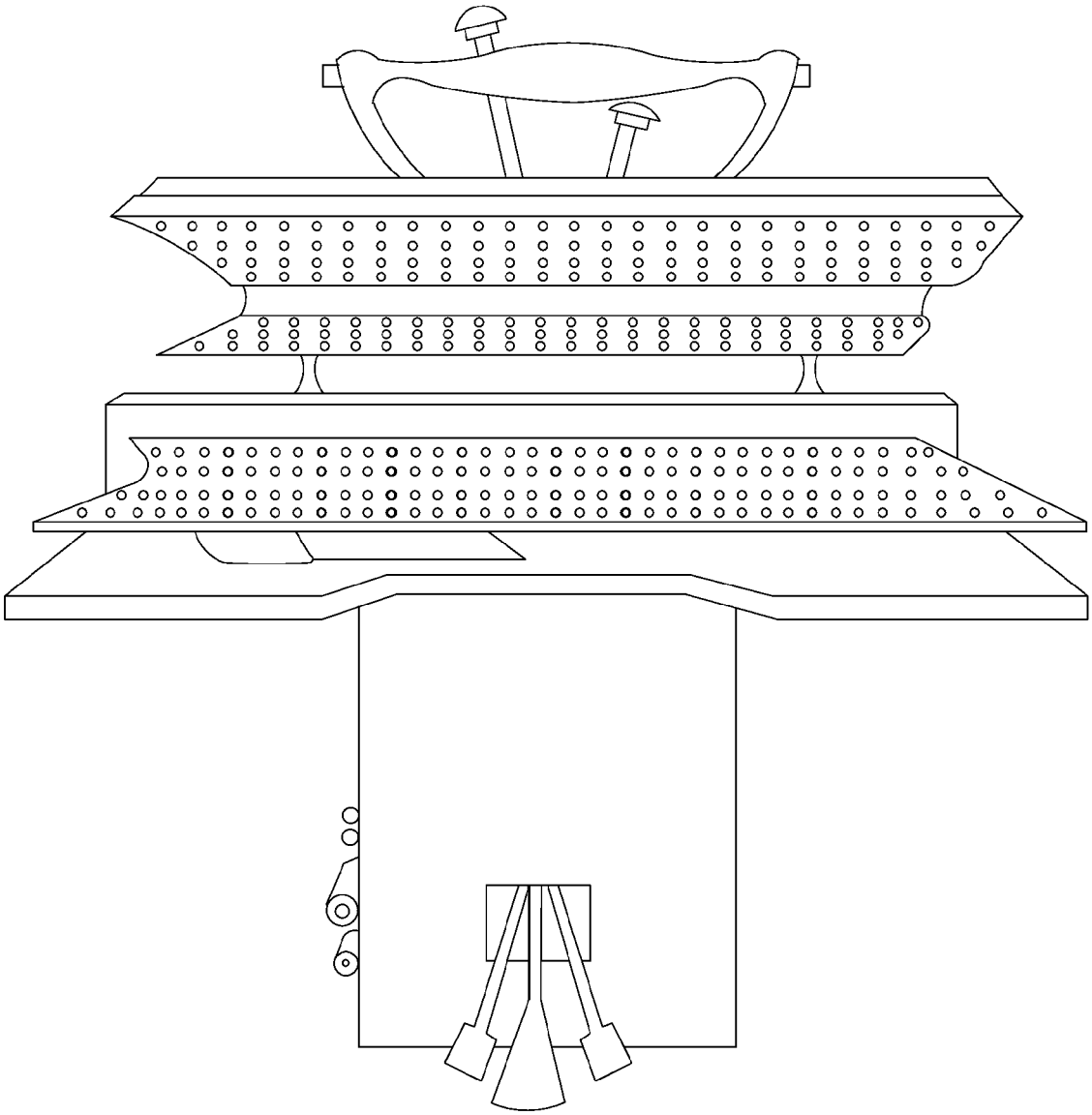
FIG. 3B is a further perspective front view, illustrating the pressing plates and clearly showing the seam indention on the top pressing plate.
Figure 3C:
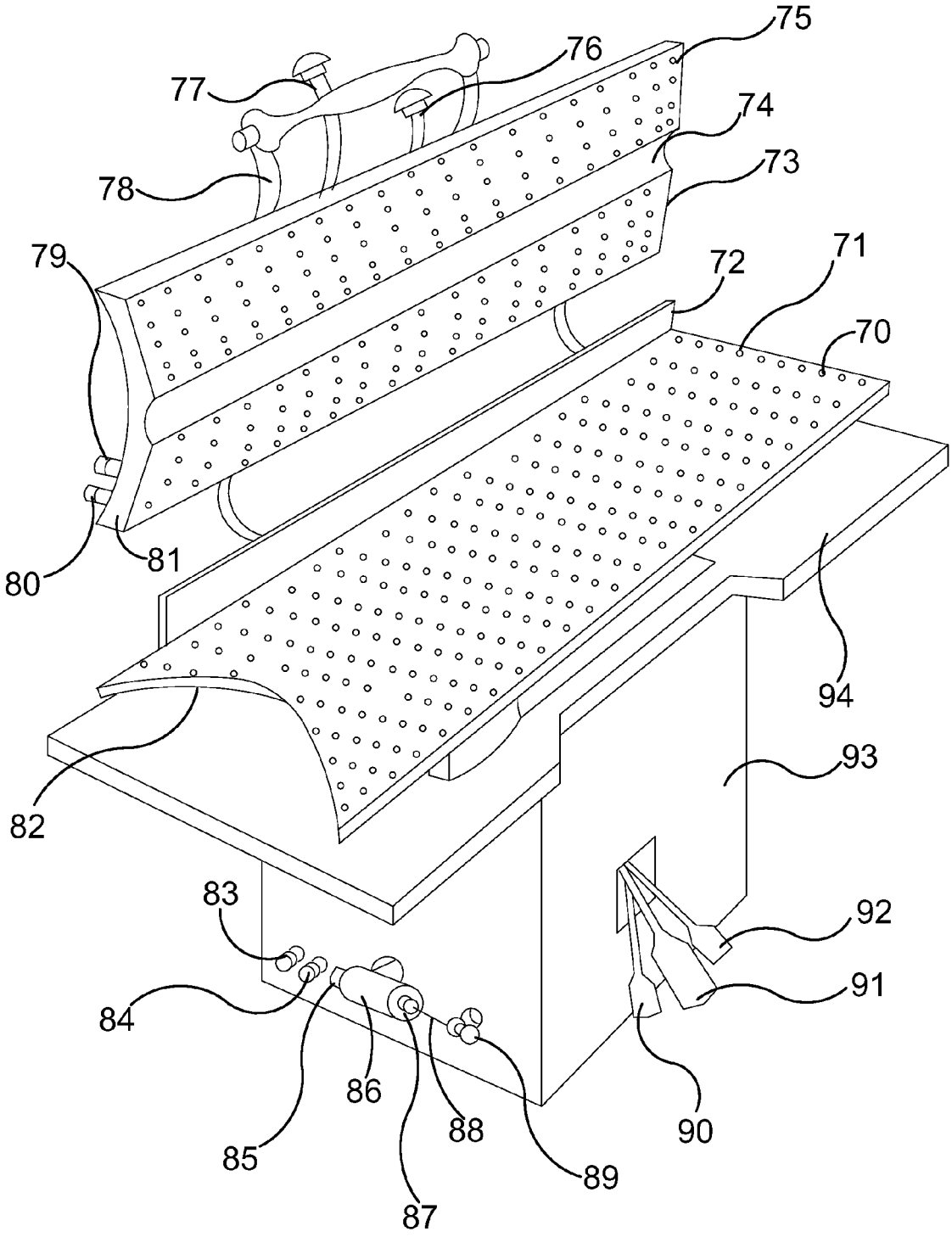
FIG. 3C is a further perspective side rear view, illustrating the steam, drain and vacuum valves connections on the top and bottom pressing plates.

One embodiment of the pants pressing machine a side view is illustrated in FIG. 3C. The pants pressing machine has two framework pressing plates. The top framework pressing plate 73 has a plurality of tiny steam outlet holes 75. The top framework pressing plate also has a longitudinal trough 74 preferably 1 to 5½ inches wide and 1 to 3 inches deep without the aforementioned steam out holes. On the top framework pressing plate 73 towards the middle is a close handle 78. Next to the close handle 78 are two levers. To the left is the steam release lever 77, to the right is the open lever 76. To the far left on the top framework pressing plate 73 are two valve connections. The top drain valve connection 80 and the top boiler valve connection 79. The left side of the top framework pressing plate 73 has a contour crotch shape 81.

The top framework pressing plate 73 is supported by a table structure 94. On top of the table structure 94 is the bottom framework pressing plate 71. The bottom framework pressing plate 71 also has a plurality of tiny steam outlet holes 70. The far left of the bottom framework pressing plate 71 also has a contour crotch shape 82. Behind the bottom framework pressing plate 71 is a back board 72.

The table structure 94 is supported by the bottom base support structure 93. To the side of the bottom support base structure 93 has three valves used for the bottom framework plate 71. To the far left by the bottom framework pressing plate 71 is the first valve, the drain valve 83. The second valve is the bottom framework pressing plate 71 boiler valve 84. The third valve is the bottom framework pressing plate 71 vacuum valve 86, the vacuum valve 86 has a vacuum valve connection 85. On the other end of the vacuum valve 86 is the vacuum pin release 87. To the far right is a wheel 89, the wheel 89 has a metal wire string 88, that attaches to the vacuum pin release 87. Near the front bottom base support structure 93 are three foot pedals. The left foot pedal 90, the middle and bigger manual foot pedal 91 and the right manual foot pedal 92.

The manner of using the pants pressing machine as shown in FIG. 3C is as such. The pant leg is placed on the bottom framework pressing plate 71. The crotch side of the pant leg is aligned with the contour crotch shape 82. The seam of the pant leg is aligned with the indention 74 of the top framework pressing plate 73.

To close the framework pressing plate 73 an operator must step on the close pedal 91 and bring down the close handle 78 at the same time. An operator then presses the steam release lever 77. Steam releases through the top framework pressing plate 73, via the plurality of tiny steam outlet holes 75 through the pant leg fabric removing wrinkles. One then steps on the left foot pedal 90. When the left foot pedal 90 is stepped on it pulls the metal wire string 88. The metal wired string 88 runs through wheel 89, which is on the side of the bottom base support structure 93. The metal wired string 88 pulls the vacuum pin release 87, which then opens the vacuum valve 86. The vacuum valve 86 opens the plurality of tiny steam outlet holes 75 on the top framework pressing plate 73 and it also opens the plurality of tiny steam outlet holes 70 on the bottom framework pressing plate 71.

The vacuum 86 pulls the air from the top framework structure 73 and the bottom framework structure 71 through the pant leg and cools the fabric down. One then presses the open lever 76 down to open the pressing machine.

The pant leg is left well pressed and due to the indention 74 on the top framework pressing plate 73. The seams on the pant leg are left unmarked and no impressions are left.

When a different garment is being pressed and extra steam is needed one would step on the right foot pedal 92. When stepping on the right foot pedal 92, steam is released into the bottom framework pressing plate 71 via the plurality tiny steam outlet holes 70. The steam leaver 77 is pressed at the same time allowing steam to enter the top framework pressing plate 73 via the tiny steam out let holes 75 into the garment. Leaving a garment fluffy and steam pressed.

Figure 3D:
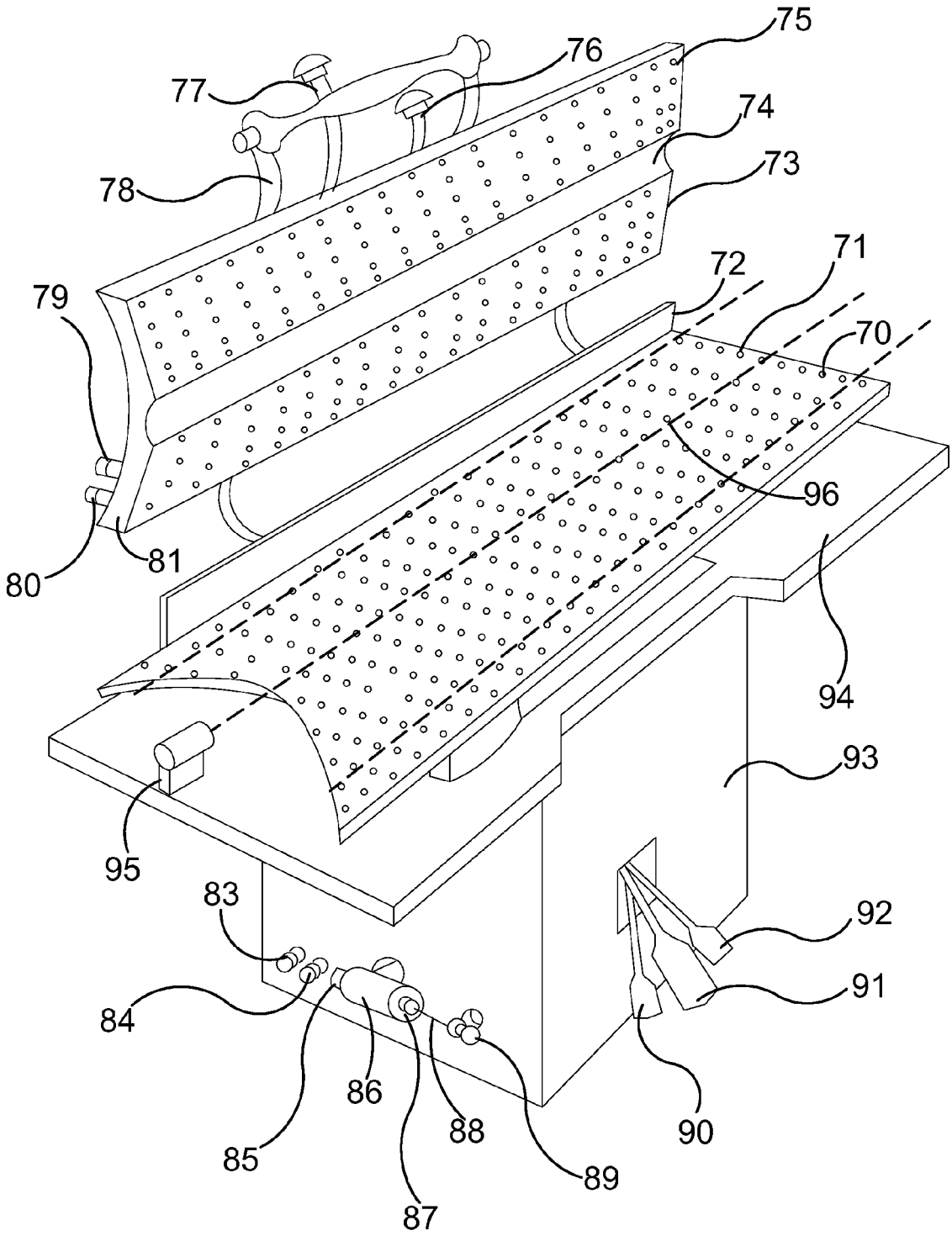
FIG. 3D is a further perspective side rear view, illustrating the laser light alignment device for aligning a seam thereover.

The manner of using the pants pressing machine as shown in FIG. 3D provides for the user of a laser 94 generating a seam alignment light 95 as a guide so that when the pants leg is placed is placed is placed on the bottom framework pressing plate 71 with the crotch side of the pant leg is aligned with the contour crotch shape 82. The seam of the pant leg is placed over the alignment light and therefore in alignment with the longitudinal trough 74 of the top framework pressing plate 73 thereby eliminating any pressing marks on the pant seam. The rest of the pressing sequences is the same as described in FIG. 3C.

What is claimed is new and desired to be protected by Letters Patent is set forth in the appended claims:

1. An industrial upper portion of pants pressing steam apparatus comprising:

a) a base having a pair of cylindrical stanchions each supporting a wheel thereon and each stanchion having a cantilevered arm supporting a wheel on their distal end;

b) a support extending vertically from one end of said base with a pair of apertures therein with each having a wheel positioned thereover;

c) a cantilevered top base fixedly attached to the top surface of said support;

d) a pair of wheels fastened to one end of said top base substantially co linear with said support wheels;

e) a framework pressing plate extending longitudinally along said top base and forming an integral part therewith;

f) a vacuum valve and a steam release valve fixed to one end of said framework pressing plate;

g) a pair of foot pedal positioned approximate said base; and h) each foot pedal having a length of line fastened thereto extending across the stanchion wheels through a respective support aperture and guide wheels to a respective top base wheel terminating at a respective vacuum valve and steam release valve.

2. The industrial upper portion of pants pressing steam apparatus of claim 1, wherein said steam release valve has a steam release pin for attachment of said steam release line so that when one of the foot pedals is manually depressed steam is released into said framework pressing plate through a plurality of framework pressing plate apertures.

3. The industrial upper portion of pants pressing steam apparatus of claim 2, wherein said vacuum valve has a pin release for attachment of said vacuum release line so that when one of the foot pedals is manually depressed vacuum is released into said framework pressing plate through a plurality of framework pressing plate apertures.

4. The industrial upper portion of pants pressing steam apparatus of claim 3, wherein said vacuum valve further comprises has a vacuum valve connection for fastening a vacuum source thereto.

5. The industrial upper portion of pants pressing steam apparatus of claim 4, wherein said framework pressing plate further incorporates a boiler valve providing connecting means for a steam source.

6. The industrial upper portion of pants pressing steam apparatus of claim 5, wherein said framework pressing plate further incorporates a drain valve for condensation of steam returning to a main drain pipe.

7. The industrial upper portion of pants pressing steam apparatus of claim 1, wherein said framework pressing plate has a triangularly shaped steam and vacuum framework pressing plate with a transverse curvilinear top surface extending longitudinally along said top base and forming an integral part therewith.

8. The industrial upper portion of pants pressing steam apparatus of claim 1, wherein said framework pressing plate has a longitudinally tapered rectangular steam and vacuum framework pressing plate extending longitudinally along said top base and forming an integral part therewith.

9. An industrial legs of pants pressing steam apparatus comprising:

a) a stand having vertically extending walls incorporating boiler valve, drain valve and vacuum valve;

b) a planar bottom plate having a plurality of apertures therein that is fixedly attached and spaced away from said stand and wherein said bottom plate has an end with a contour crotch shape for abutting the crotch of a pair of pants with the leg thereof extending along said bottom plate;

c) a planar top plate having a plurality of apertures therein hingedly attached to a back plate of said stand and has a similar contour crotch shape;

d) a plurality of foot pedals for engaging and disengaging said steam and said vacuum; and e) wherein said top plate has a longitudinal trough without apertures therein where a seam of said pants leg resides during pressing leaving no impression marks on said seam.

10. The industrial legs of pants pressing steam apparatus of claim 9, wherein said top plate further comprises boiler valve connection and condensation drain valve connection.

11. The industrial legs of pants pressing steam apparatus of claim 10, wherein said top plate further comprises a close handle and an open lever.

12. The industrial legs of pants pressing steam apparatus of claim 11, wherein said top plate further incorporates a steam release lever.

13. The industrial legs of pants pressing steam apparatus of claim 9, wherein one of said stand foot pedals release steam into said bottom plate when depressed.

14. The industrial legs of pants pressing steam apparatus of claim 9, wherein one of said foot pedals release vacuum into said bottom plate when depressed.

15. The industrial legs of pants pressing steam apparatus of claim 9, wherein one of said foot pedals moves said top plate into engagement with said bottom plate for pressing a plants leg therebetween.

16. The industrial legs of pants pressing steam apparatus of claim 9 wherein said longitudinal trough is preferably 1 to 5½ wide and 1 to 3 inches in depth.

17. An industrial legs of pants pressing steam apparatus comprising:

a) a stand having vertically extending walls incorporating boiler valve, drain valve and vacuum valve;

b) a planar bottom plate having a plurality of apertures therein that is fixedly attached and spaced away from said stand;

c) a planar top plate having a plurality of apertures therein hingedly attached to a back plate of said stand;

d) a plurality of foot pedals for engaging and disengaging said steam and said vacuum; and e) wherein said stand further incorporates a laser for projecting a line longitudinally along said bottom plate as a seam placement guide so that the seam falls within the top plate longitudinal trough during pressing.

* * * * *